United States Patent [19]

Estes et al.

[11] 4,250,016

[45] Feb. 10, 1981

[54] RECOVERY OF BITUMEN FROM TAR SAND

[75] Inventors: John H. Estes, Wappingers Falls; Ernest P. Buinicky, Newburch, both of N.Y.

[73] Assignee: Texaco Inc., White Plains, N.Y.

[21] Appl. No.: 962,277

[22] Filed: Nov. 20, 1978

[51] Int. Cl.[3] ..... C10G 1/04; C10G 29/08

[52] U.S. Cl. ..... 208/11 LE; 208/289

[58] Field of Search ..... 208/11 LE, 289

[56] References Cited

U.S. PATENT DOCUMENTS

| | | | |
|---|---|---|---|
| 3,607,720 | 9/1971 | Paulson | 208/11 LE |
| 3,930,988 | 1/1976 | Johnson | 208/289 |
| 3,953,317 | 4/1976 | Myers | 208/11 LE |

*Primary Examiner*—Herbert Levine

*Attorney, Agent, or Firm*—Carl G. Ries; Robert A. Kulason; Jack H. Park

[57] ABSTRACT

A process for recovering bitumen, or heavy petroleum, from admixture with sand and similar inorganic materials wherein said bitumen-sand mixture is mixed with an aqueous solution of an ammonium salt selected from ammonium sulfite, ammonium bisulfite and mixtures thereof to form a second mixture comprising said aqueous ammonium salt solution, bitumen and sand; wherein said second mixture is heated to a temperature in the range of about 120° F. (45° C.) to about 260° F. (127° C.) and is separated into a bitumen phase free of sand, an aqueous phase and a sand phase.

9 Claims, 1 Drawing Figure

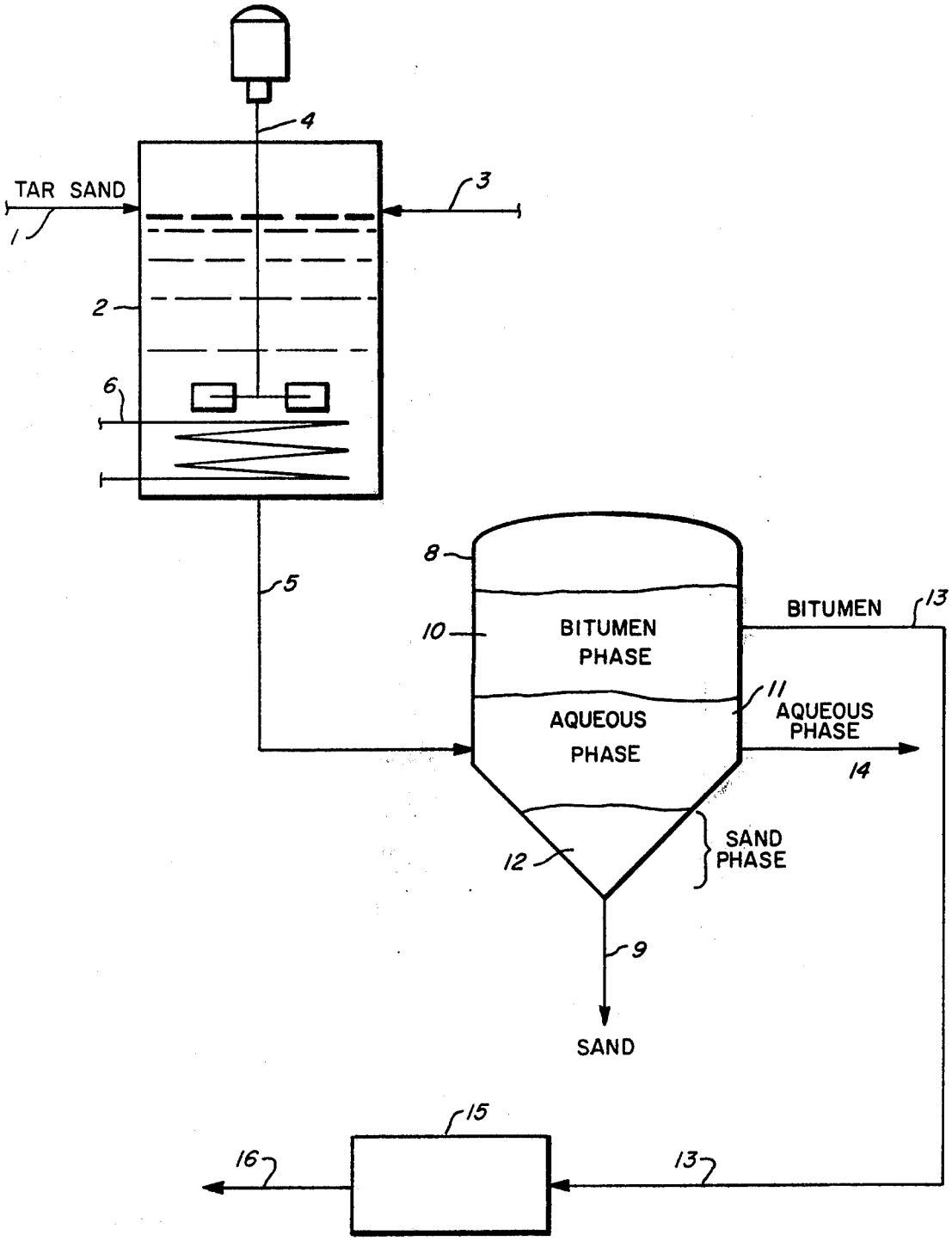
TAR SAND
1
2
3
4
5
6
8
9
10
11
12
13
14
15
16
BITUMEN PHASE
AQUEOUS PHASE
SAND PHASE
BITUMEN
AQUEOUS PHASE
SAND

RECOVERY OF BITUMEN FROM TAR SAND

This application is related to Application Ser. No. 918,633, filed June 23, 1978 and now abandoned.

BACKGROUND OF THE INVENTION

The present invention relates to separation of heavy petroleum hydrocarbons from admixture with inorganic particulate material. More particularly the present invention relates to a process wherein tar sands, or other mixtures of heavy petroleum with sand or similar particulate material, is treated under mild conditions with an aqueous solution of an ammonium salt selected from ammonium sulfite, ammonium bisulfite, and mixtures thereof for separation into bitumen substantially free of sand, and sand substantially free of bitumen.

Tar sands (also known as oil sands and bitumen sands) occur naturally in earth formations ranging in depth from surface deposits to several thousand feet. Such, tar sands are unconsolidated sand deposits impregnated with dense, viscous petroleum. The petroleum is a bitumen (i.e. soluble in carbon disulfide) and has a density at 60° F. slightly greater than water. Up to about 50% of the bitumen may be distilled without cracking and a substantial portion of the bitumen comprises asphaltenes and resins.

Recovery of tar sands from earth formations may be accomplished by surface mining techniques wherein the tar sands are transported to processing units for separation of bitumen from sand. Alternatively, in situ recovery techniques, such as fire floods, emulsion steam drives or solvent drives may be employed for recovering bitumen and leaving sand behind in the earth formation. Bitumen so recovered, even with in situ recovery techniques, may contain substantial amounts of sand in admixture therewith.

Processes are known for recovering bitumen substantially free of admixed sand. Such process include extraction with anhydrous solvent; bitumen separation employing a water-hydrocarbon mixture at about 70°–200° F. and a water pH of 9–9.5; bitumen separation employing water at about 70°–200° F. and a pH of 8–8.5.

The anhydrous solvent recovery processes require large amounts of expensive solvents which must be recovered by distillation for recycle. Thus, such processes are expensive to operate, and require substantial energy input.

The various techniques for recovering bitumen employing water or water-hydrocarbon mixtures are all operated in the basic pH range. In the presence of polyvalent ions, clay minerals tend to flocculate with the bitumen under basic pH conditions, forming slimes which are difficult to separate from the water. Additionally, the bitumen tends to form a froth, or emulsion which must be further treated to recover bitumen free of water.

SUMMARY OF THE INVENTION

Now, according to the present invention, we have discovered an improved method for recovering bitumen from tar sand, or from admixture with sand and similar inorganic particles. Although the process is described in terms of separating bitumen from tar sands, it is to be understood that the process is generally applicable to separating heavy petroleum from sand and similar minerals.

A preferred embodiment of the present invention comprises: mixing, in a mixing zone one volume tar sand, comprising bitumen admixed with sand, with about 0.5 to 3 or more volumes of an aqueous solution of an ammonium salt selected from ammonium sulfite, ammonium bisulfite and mixtures thereof, having an ammonium salt concentration in the range of about 0.01 to about 1.0 moles/liter, under conditions of agitation sufficient for contacting said sand with said liquid aqueous solution, at a temperature in the range of about 120° F. (45° C.) to about 260° F. (127° C.);

separating, in a gravity separation zone said aqueous solution-tar sand mixture, at a temperature in the range of about 100° F. (38° C.) to about 260° F. (127° C.), into a bitumen phase substantially free of sand, an aqueous phase, and a bottom sand phase substantially free of bitumen;

recovering, by liquid-liquid separation means, said bitumen phase, substantially free of sand and similar inorganic materials, from said separation zone; and recovering, by solid-liquid separation means said sand from said separation zone.

The advantages of the process of the present invention include recovering bitumen, or heavy petroleum, substantially free of sand and similar inorganic materials. Additionally, bitumen recovery from the tar sand is increased and the separated sand is substantially free of bitumen. The process of the present invention is simple and operating conditions are mild, thus reducing investment and operating costs for the process. These and other advantages will be discussed more fully in the detailed description which follows.

BRIEF DESCRIPTION OF THE DRAWING

The drawing is a schematic representation of a bitumen recovery process embodying the improved process of the present invention.

DETAILED DESCRIPTION OF THE INVENTION

The process of the present invention is for separating bitumen, or other heavy petroleum, from sand and similar inorganic materials, such that the bitumen is recovered substantially free of sand, and the sand is substantially free of bitumen. For convenience, the process is discussed herein in terms of recovering bitumen from tar sand, which is one of the larger applications for the process. However, it is to be understood that the process is applicable to separating heavy petroleum hydrocarbons from sand and similar inorganic materials.

Tar sands are naturally occuring deposits which comprise mixtures of heavy petroleum hydrocarbons (bitumen), water, and sand. The sand is primarily quartz, but also contains clay minerals and the like in small amounts. The natural deposits vary in their physical properites considerably, and the bitumen is variable from very heavy oil to asphalt. Representative of such tar sand deposits are those of the Athabasca Region of Canada. The Athabasca tar sands comprise a mixture of sand, water and bitumen wherein the sand component is predominantly quartz, each grain of which is wet with a film of water. Surrounding the wetted sand gains, and somewhat filling the void volume is a film of bitumen. The balance of the void volume is filled with connate water and some small volume of gas. The sand grains are packed to a void volume of about 35%.

Bitumen from the Athasbasca tar sand has a density at 60° F. (15° C.) slightly greater than water (e.g. API gravity, 6.5–8.6). The bitumen comprises a substantial proportion of asphaltenes and resins. Up to about 50% of the bitumen is lighter petroleum which can be distilled without cracking. The bitumen contains about 4.5–5 wt.% sulfur and about 0.4–0.5 wt.% nitrogen. Viscosity of the bitumen, at 70° F. (21° C.) is in the range of 50,000 to 2,000,000 centistokes, depending upon source tar sand deposit. Although bitumen is more dense than water at 70° F. (21° C.), a gravity inversion occurs within the range of about 100° F. (38° C.) to about 260° F. (127° C.).

Aqueous solutions of ammonium sulfite, ammonium bisulfite and mixtures thereof have been found useful, under process conditions disclosed herein, in separating bitumen from tar sand. The aqueous solutions provide a liquid phase immiscible with bitumen which aids in maintaining separation between bitumen and sand. The disclosed ammonium salts are useful in obtaining separation of bitumen from sand grains in tar sands. Aqueous solutions of these ammonium salts are not particularly corrosive at the disclosed temperatures and are relatively safe to handle, (especially solutions of ammonium sulfite). No theory of operations is proposed herein to explain the utility of such ammonium salts in separating bitumen from tar sands. It is noted, however, that at elevated temperatures (e.g. above about 120° F.) the ammonium salts tend to disassociate into ammonia and sulfur dioxide.

For obtaining a clear understanding of the process of the present invention attention is brought to the drawing. The drawing is a schematic representation of a process embodying the improvement of the present invention. The drawing is exemplary only and is not intended as a limitation of the present invention the scope of which is defined in the claims appended to this specification. Many elements, such as pumps, valves, instrumentation, etc., commonly employed in commercial processes have been omitted from the drawing for the sake of clarity. Only those elements are present in the drawing which are required to fully describe the improved process of the present invention.

In the drawing, tar sand, comprising water, bitumen, and sand in admixture, in line 1 is charged into mixing vessel 2. An aqueous solution of an ammonium salt selected from the group consisting of ammonium sulfite, ammonium bisulfite, and mixtures thereof in line 3 is charged to mixing vessel 2 in an amount equivalent to about 0.5 to about 3 or more volumes said aqueous solution per volume of tar sand.

In mixing vessel 2, the tar sand and aqueous solution are mixed, with mixer 4 at a degree of agitation sufficient for the sand grains of the tar sand to come in contact with the aqueous solution. Mixer 4 may be any conventional mixing device such as a propeller mixer, a turbine mixer, a mixing pump, etc. The degree of mixing is preferably sufficient to maintain sand and bitumen in suspension with the aqueous solution.

The aqueous ammonium salt solution may contain from about 0.01 moler/liter to about the saturation limit of an ammonium salt selected from the group consisting of ammonium sulfite, ammonium bisulfite, and mixtures thereof. Preferably, the aqueous solution contains about 0.08 to 0.12 moles ammonium salt per liter. Water employed to formulate the aqueous solution need not be pure, and may contain dissolved materials which do not interfere with the herein disclosed separation process. The water may be obtained from any convenient source such as surface water, ground water, etc.

Within mixing zone 2 said tar sand and said aqueous solution are mixed at a temperature in the range of about 120° F. (48° C.) to about 260° F. (127° C.), preferably in the range of about 180° F. (82° C.) to about 212° F. (100° C.). Heat for maintaining temperature within mixing zone 2 may be provided by any convenient means such as pre-heating the tar sand, or adding heat to mixing zone 2 by direct, or indirect heat exchange. In the drawing heater 6 is located in mixing zone 2 for supplying heat to the tar sand-aqueous solution mixture. Heater 6 may be an indirect heat exchanger or a device for directly heating the mixture such as a steam injector. In mixing zone 2 the mixture is heated to a temperature at which the density of the bitumen is less than the density of the aqueous solution (commonly, in the range of about 100° F. (38° C.) to about 260° F. (127° C.)) and at which the selected ammonium salt tends to disassociate into ammonia and sulfur dioxide (e.g. about 120° F. (49° C.) for ammonium bisulfite and about 160° F. (71° C.) for ammonium sulfite). Thus, temperature in mixing zone 2 below about 120° F. (49° C.) is not sufficient to obtain the advantage of the ammonium salts in separating bitumen from tar sand, and temperatures above about 260° F. (127° C.) are within a range wherein bitumen is heavier than the aqueous solution, and consequently will not separate from the sand. Preferably, the mixture is not heated above its boiling point, at operating pressure.

Pressures in mixing zone 2 are maintained such that substantial vaporization does not occur. Pressures in the range of atmospheric to about 50 psig, depending upon the mixture temperature are adequate. Subatmospheric pressures are not favored.

In the drawing, upon mixing and heating, the aqueous solution-tar sand mixture is transferred from mixing zone 2 via line 5 to settler vessel 8. In settler vesssel 8 the mixture is maintained in a quiescent state, at a temperature in the range of about 100° F. (38° C.) to about 260° F. (127° C.). Bitumen, aqueous solution, and sand separate in settler vessel 8, forming an upper bitumen phase 10, an intermediate aqueous phase 11, and the sand settles to the bottom 12. In this separation step, gravity separation, as shown in settler vessel 8 is preferred. However, any applicable separation device, such as a hydrocyclone, centrifuge, etc., may be used. In settler vessel 8, the bitumen separates substantially free of sand and inorganic particulate materials, and the sand is substantially free of bitumen.

In the drawing, sand is withdrawn from settler vessel 8 via line 9 for disposal, not shown. The aqueous phase, comprising aqueous ammonium salt solution is withdrawn via line 14 for disposal, not shown.

In the drawing, bitumen from settler vessel 8 is withdrawn via line 13 to a filter 15 wherein any small amount of solids entrained are removed. From filter 15, bitumen free of solids are transferred via line 16 to further processing, not shown. Filter 15 may be any convenient filter, such as plate and frame, rotary drum, etc. Bitumen may be heated or diluted with light solvent such as naphtha, vythene, light aromatics, etc. for reducing viscosity. Filtration may be dispensed with when solids content of separated bitumen is low.

EXAMPLE

In order to demonstrate the process of the present invention and its advantage over the prior art, the following experiments were performed for separating bitumen from tar-sand.

The tar sand employed in the following experiments was a sample obtained from the Athabasca Tar Sand deposit, and comprised 14.5 wt.% bitumen (8.2 deg. API), 2.12 wt.% water and 83.28 wt.% mineral matter. The mineral matter composition was:

QUARTZ: 96%
CLAY: 2%
POTTASIUM FELDSPAR: 1%
CALCITE: 1%

In a first comparative experiment, 50 grams of the above tar sand, containing 7.31 grams bitumen, was heated with 300 cc water in a stirred vessel until separation of oil and sand occurred. Heating the tar sand-water mixture to 180° F. (82° C.) was required to obtain separation of bitumen. Upon separation of bitumen and sand, agitation of the mixture was halted and the mixture separated into a bitumen phase, an aqueous phase, and a solid sand phase. At the temperature of this experiment, the bitumen phase accumulated upon the surface of the aqueous phase. The sand phase, although free of a binding oil film, remained dark colored. The aqueous phase appeared muddy, and separation of emulsified bitumen therefrom required standing, without agitation, for a period of several hours. Bitumen recovered was viscous and blinded a filter upon an attempt to detrain solids from this tar sand separation.

In a second experiment, embodying the process of the present invention, a sample of the above tar sand, was treated with a 0.1 molar solution of ammonium bisulfite in water. Fifty grams of tar sand and 300 cc of said ammonium bisulfite solution were combined in a stirred vessel at 180° F., forming a mixture. Clean, light colored sand began separating, and the bitumen was observed agglomerating upon the water surface. The aqueous phase present was clear and free of emulsified hydrocarbon. Upon ceasing agitation, the mixture separated into an upper bitumen phase, an intermediate aqueous phase, and a lower sand phase. The aqueous phase was clear, and the sand was white with dark flecks. The bitumen phase was fluid, and was easily filtered upon dilution with vythene solvent.

In a third experiment, constituting a second embodiment of the process of the present invention, a sample of the above tar sand was treated with a 0.1 molar solution of ammonium sulfite in water. Fifty grams of tar sand and 300 cc of said ammonium sulfite solution were combined in a stirred vessel at 180° F., forming a mixture. Clean, light colored sand began separating, and bitumen was observed agglomerating upon the water surface. The aqueous phase present was clear and free of emulsified hydrocarbon. Upon ceasing agitation, the mixture separated into an upper bitumen phase, an intermediate aqueous phase, and a lower sand phase. The aqueous phase was clear and the sand was white with dark flecks. The bitumen phase was fluid, and was easily filtered upon dilution with vythene solvent. Upon filtration, 6.64 grams (90.96%) bitumen was recovered as filtrate and 2.3 grams quartz particles with occluded bitumen were recovered as solids upon the filter.

We claim:

1. A process for recovering bitumen from a tar sand comprising bitumen in admixture with sand grains; which process comprises:

(a) mixing in a mixing zone, said tar sand with an aqueous solution of an ammonium salt selected from the group consisting of ammonium sulfite, ammonium bisulfite, and mixtures thereof under conditions of agitation sufficient for contacting said sand grains with said aqueous solution, at a temperature in the range of about 120° F. to about 260° F., for forming a tar sand-aqueous solution mixture;

(b) separating, in a separation zone, said tar sand-aqueous solution mixture, at an elevated temperature sufficient to reduce the density of bitumen to a value lower than the density of said aqueous solution, into a bitumen phase, an aqueous solution phase, and a sand phase; and (c) recovering said bitumen phase substantially free of said aqueous phase and said sand phase.

2. The process of claim 1 wherein the concentration of ammonium salt in said aqueous solution is within the range of from about 0.01 gram moles/liter to about the saturation limit, and wherein the volume ratio of aqueous solution to tar sand is within the range of about 0.5:1 to about 3:1 or greater.

3. The process of claim 2 wherein the elevated temperature in said settling zone is within the range of about 100° F. to about 260° F.

4. The process of claim 3 wherein said process is continuous and wherein separation of said tar sand-aqueous solution mixture is by settling under quiescent conditions.

5. The process of claim 3 wherein said bitumen phase recovered from said separation zone is filtered in a filtration zone for separating any solids from the bitumen.

6. The process of claim 5 wherein said separated bitumen is diluted with solvent prior to filtration.

7. A process for recovering heavy petroleum from admixture with sand grains, which process comprises:

mixing, in a mixing zone, said petroleum-sand mixture with an aqueous solution of an ammonium salt selected from the group consisting of ammonium sulfite, ammonium bisulfite, and mixtures thereof at a temperature in the range of about 120°–260° F. for forming an aqueous solution-petroleum-sand mixture;

separating, in a settling zone, said aqueous solution-petroleum-sand mixture under quiescent conditions, at an elevated temperature, into an upper petroleum phase, an intermediate aqueous phase, and a bottom sand phase;

recovering, by liquid-liquid separation means, said petroleum phase from said aqueous phase; and recovering, by solid-liquid separation means, said aqueous phase from said sand phase.

8. The process of claim 7 wherein said aqueous solution comprises about 0.01 gram moles/liter to about the saturation concentration of said ammonium salt dissolved in water; and wherein said separated petroleum phase is filtered to separate any solids therefrom.

9. The process of claim 8 wherein said process is continuous.

* * * * *